US005313810A

United States Patent [19]

Koven

[11] Patent Number: 5,313,810

[45] Date of Patent: * May 24, 1994

[54] NECKWEAR KNOT ENHANCER

[76] Inventor: Melvin R. Koven, P.O. Box 52, Chama, N. Mex. 87520

[ * ] Notice: The portion of the term of this patent subsequent to Aug. 4, 2009 has been disclaimed.

[21] Appl. No.: 923,335

[22] Filed: Jul. 31, 1992

Related U.S. Application Data

[63] Continuation of Ser. No. 626,820, Dec. 13, 1990, Pat. No. 5,134,861.

[51] Int. Cl.[5] ..... A44C 25/00

[52] U.S. Cl. ..... 63/2; 63/19; 63/29.1

[58] Field of Search ..... 63/2, 20, 26, 29.1, 63/32, 12, 14.1, DIG. 3; 116/234-237; 24/24, 49 C, 49 A, 49 KC, 49 R; D11/202, 1, 2

[56] References Cited

U.S. PATENT DOCUMENTS

| | | | |
|---|---|---|---|
| D. 25,771 | 7/1896 | Hennessy . | |
| D. 26,727 | 3/1897 | Smith . | |
| D. 56,634 | 12/1949 | Lang . | |
| D. 97,353 | 10/1935 | Lester . | |
| 454,380 | 6/1891 | Rabby | 24/49 R X |
| 529,184 | 11/1894 | Oppenheimer | 63/20 X |
| 556,080 | 3/1896 | Ashby . | |
| 559,567 | 5/1896 | Chamberlin | 63/26 X |
| 580,578 | 4/1897 | Klein | 24/49 R X |
| 896,941 | 8/1908 | Rothschild | 63/20 X |
| 1,093,516 | 4/1914 | Winterhaler et al. . | |
| 1,160,723 | 11/1915 | Lander | 63/29.1 |
| 1,477,461 | 12/1923 | Smith | 24/49 R X |
| 2,121,402 | 6/1938 | Knoebel, Jr. . | |
| 2,599,921 | 6/1952 | Johnson | 63/20 X |
| 2,749,920 | 6/1956 | Kriesman et al. | 63/DIG. 3 |
| 3,827,108 | 8/1974 | Jewett | 24/49 CF |
| 4,173,793 | 11/1979 | Yasui | 2/152 A |
| 4,723,422 | 2/1988 | Foster | 63/2 X |
| 5,134,861 | 8/1992 | Koven | 63/2 |

FOREIGN PATENT DOCUMENTS

| | | | |
|---|---|---|---|
| 441844 | 4/1912 | France | 116/237 |
| 1460915 | 10/1966 | France | 63/20 |

*Primary Examiner*—Peter M. Cuomo
*Assistant Examiner*—Jerry Redman
*Attorney, Agent, or Firm*—Rod D. Baker; Deborah A. Peacock

[57] ABSTRACT

A neckwear knot enhancer comprising a detachable display device mounted on the anterior portion of a support. The support is retained on a neckwear knot solely by frictional forces on the posterior portion of the support.

17 Claims, 3 Drawing Sheets

NECKWEAR KNOT ENHANCER

This is a continuation of copending application Ser. No. 07/626,820 filed Dec. 13, 1990 issuing on Aug. 4, 1992 as U.S. Pat. No. 5,134,861.

BACKGROUND OF THE INVENTION

1. Field of the Invention (Technical Field):

The invention relates to a neckwear knot enhancer, and more particularly to a neckwear knot enhancer retained only by friction and capable of mounting a variety of display devices.

2. Background Art:

Various neckwear devices, ornamental and functional, are known to the prior art. Some devices are both functional and ornamental, such as U.S. Pat. No. 4,173,793, to Yasui, entitled Knot Retaining Implement for Necktie or Scarf, which provides knot and tie tack retention. Another neckwear device having utilitarian as well as ornamental use is U.S. Pat. No. 1,093,516, to Winterhalter, et al., entitled Display Device or Badge. U.S. Pat. No. 2,121,402, to Knoebel, Jr., entitled Necktie Holder, teaches a collar button-mounted pin for supporting a necktie.

U.S. Pat. No. De. 26,727, to Smith, entitled Design for a Necktie Retainer, illustrates an "s"-shaped tie clip, apparently engageable with a necktie by spring action.

U.S. Pat. Nos. De. 25,771, to Hennessy, entitled Necktie Holder; and U.S. Pat. No. De. 156,634, to Lang, entitled Tie clip or Similar Article lock interchangeable display devices and are retained by spring action. U.S. Pat. No. 556,080, to Ashby, entitled Scarf Ring, teaches a scarf pin having a reciprocating motor (air, spring, or electric) for actuating a pin-mounted figure.

Perhaps the most relevant is U.S. Pat. No. De. 97,353, to Lester, entitled Clip for Necktie Knots. While apparently designed specifically for necktie knots, Lester is apparently retained to a tie knot by spring action and lacks any teaching of an interchangeable or replaceable display device.

The prior art, accordingly, fails to teach a neckwear knot enhancer, secured to a neckwear knot solely by friction, and providing interchangeable display devices.

SUMMARY OF THE INVENTION (DISCLOSURE OF THE INVENTION)

In accordance with the preferred embodiment of the invention there is provided a support for a neckwear knot display device comprising an anterior portion comprising a display device attachment and a posterior portion functionally and inelastically engaging the neckwear knot. The anterior and posterior portions are connected by a curved connecting portion extending over the outermost layer of the neckwear knot.

In the preferred embodiment, the display device may be attached by a post and spring clamp, link and chain or a threaded connection. The display device may also be attached by welding, brazing, soldering, and bolting.

In the preferred embodiment, the display device may comprises a gem, a fraternal emblem, or a signet. In the preferred embodiment, the support may comprise a metal selected from the group consisting of gold, silver, platinum, aluminum, palladium, beryllium, indium, iron, nickel, and their alloys. The support may also comprise a non-metal selected from the group consisting of plastic, rubber, ivory, horn, and amber.

The preferred embodiment of the invention also comprises a support for a neckwear knot display device comprising a neckwear knot comprising an outermost loop of material, and a neckwear knot display device support comprising a first anterior portion detachably supporting the display device and extending forwardly and downwardly of the outermost loop of material. The neckwear knot display device support further comprises a second posterior portion extending rearwardly and downwardly of the outermost loop of material, and a third portion inelastically connecting the anterior and posterior portion and curvedly extending over the outermost loop of material, whereby the support is retained solely by friction.

The preferred embodiment of the invention further comprises the second posterior portion comprising bifurcated legs. Alternatively, the second posterior portion may comprise a disk, a loop, or square or triangular plates.

An object of the invention is the provision of a neckwear knot enhancer retained solely by frictional means.

Yet another object of the invention is the provision of a neckwear knot enhancer providing interchangeable display devices.

An advantage of the invention is the relative ease of mounting and dismounting the neckwear knot enhancer from neckwear.

Yet another advantage of the invention is the ease with which display devices may be interchanged.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DESCRIPTION OF THE PREFERRED EMBODIMENTS (BEST MODE FOR CARRYING OUT THE INVENTION)

FIGS. 1–6 depict the preferred embodiment of the invention. As illustrated therein, perhaps best depicted in FIGS. 6 and 7, neckwear 7, which may be a necktie, cravat, neckerchief, scarf or the like, comprises a suitable knot 8. Knot 8 may, for example, be a Windsor, half-Windsor, Shelby, four-in-hand, or the like, and further comprises an outermost layer or loop of material 9.

Figure 12:
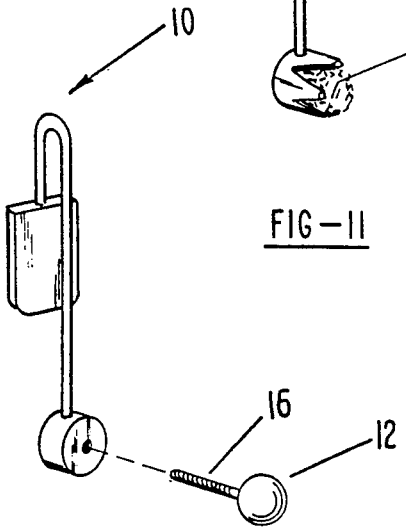
FIG. 12 is an exploded view of the FIG. 10 embodiment, showing a threaded connection of the display device to the support.
Figure 13:
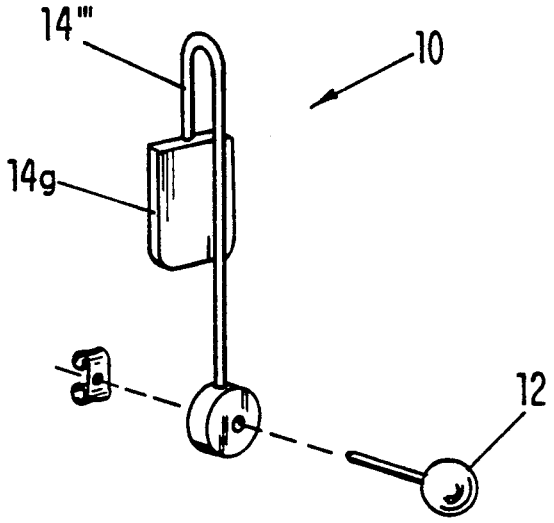
FIG. 13 is an exploded perspective view of the FIG. 10 embodiment, showing a post and spring clamp connection of the display device to the support.
Figure 14:
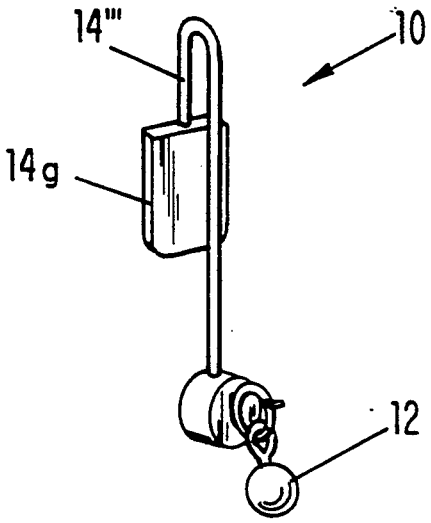
FIG. 14 is a perspective view of the FIG. 10 embodiment, showing a link-and-chain connection of the display device to the support.
Figure 15:
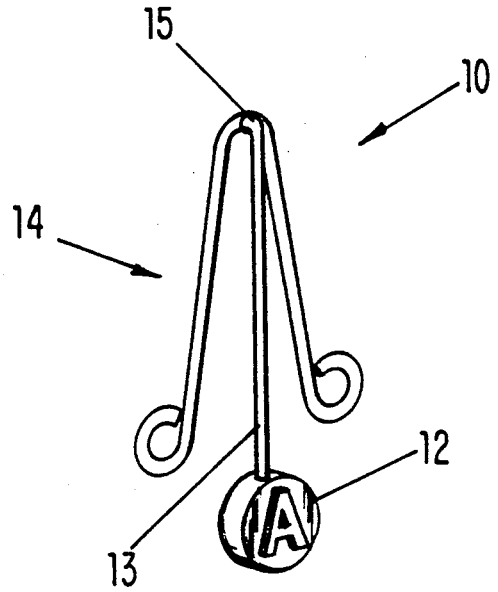
FIG. 15 is a perspective view of an alternate embodiment of the invention, showing a signet within the display device.
Figure 16:
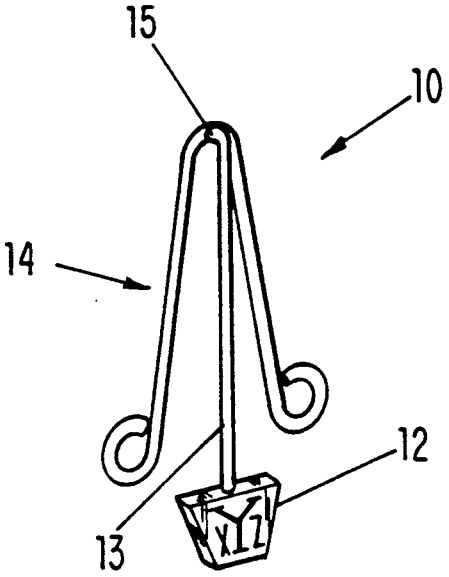
FIG. 16 is a perspective view of an alternate embodiment of the invention, showing an emblem within the display device.

Neckwear knot enhancer 10 comprising support 11 and display device 12 is mounted upon knot 9. Display device 12 may comprise, for example, mounted precious or semi-precious gems as depicted in FIGS. 1–7; a metal or cloisonne medallion, coin or signet as shown in FIG. 15. a fraternal, collegiate or corporate emblem or insignia, as shown in FIG. 16 or the like. Preferably, display device 12 is detachably secured (not shown) to support 11 by, for example, a post and spring clip FIG. 13, threaded connection (FIG. 12), link-and-chain FIG. 14, or any other detachable securement or fastening means well-known to those ordinarily skilled in the art. Alternatively, display device 12 may be relatively permanently secured to support 11 by welding, brazing, soldering, bolting or other means equally well-known to those ordinarily skilled in the art.

Figure 1:
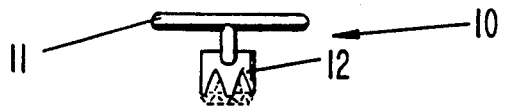
FIG. 1 is a top view of the preferred embodiment of the invention.
Figure 2:
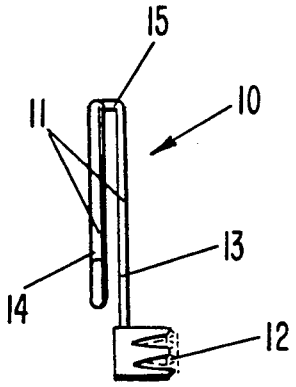
FIG. 2 is a side view of the preferred embodiment of the invention.
Figure 3:
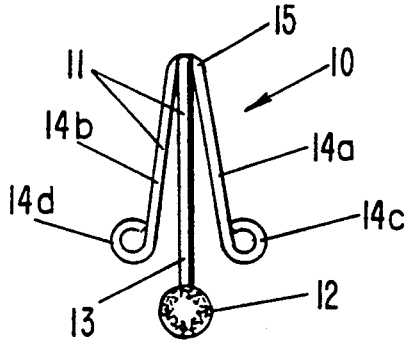
FIG. 3 is a front view of the preferred embodiment of the invention.
Figure 4:
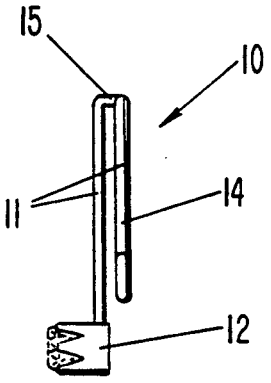
FIG. 4 is the other side view of the preferred embodiment of the invention.
Figure 5:
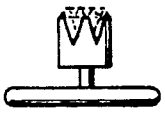
FIG. 5 is a bottom view of the preferred embodiment of the invention.
Figure 6:
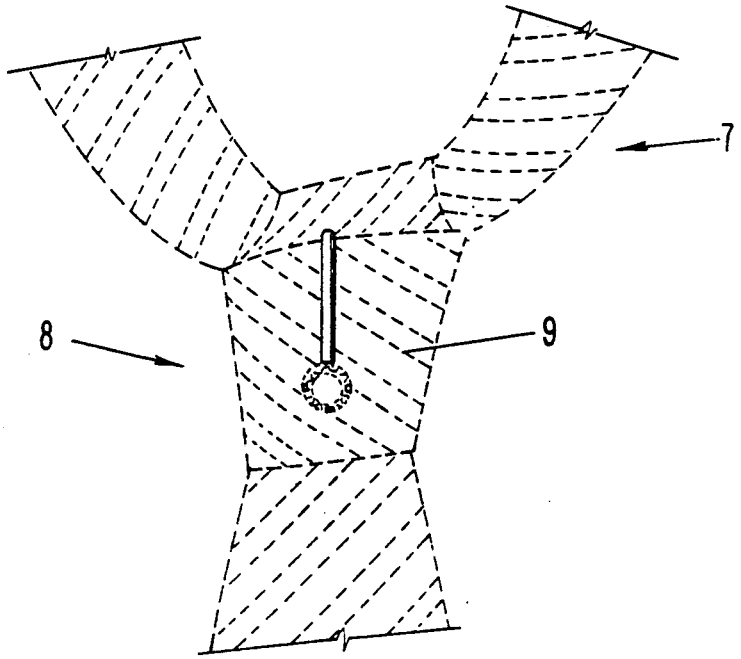
FIG. 6 is a front view of the preferred embodiment of the invention mounted upon a neckwear knot.
Figure 7:
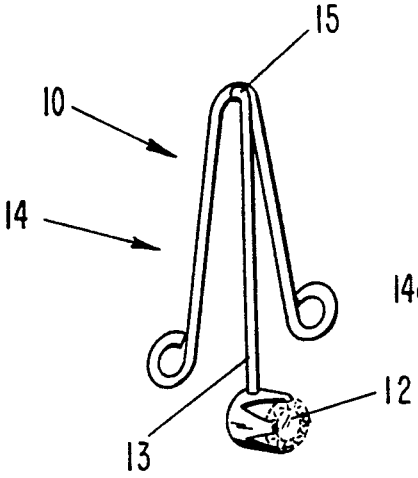
FIG. 7 is a perspective view of the preferred embodiment of the invention.

In the preferred embodiment, support 11 comprises an anterior, or forward portion 13, a rearward or posterior portion 14, and a curved connecting portion 15. Anterior or forward portion 13 comprises the sole support for display device 12. Anterior portion 13, as best depicted in FIG. 6, extends forwardly and downwardly over outermost layer 9 of knot 8.

Curvilearly extending over layer 9 is curved connecting portion 15. Connecting portion serves to join anterior portion 13 and posterior portion 14 which extend downwardly in generally parallel relationship, as depicted in FIGS. 1–6. Connecting portion 15 exerts no spring force in any direction, forwardly or rearwardly; accordingly, support 11 may be considered relatively inelastic in this regard.

Posterior or rearward portion 14 of support 11 provides retention for neckwear knot enhancer 10. Posterior portion 14, positioned rearwardly of outermost layer 9, retains and secures support 11 solely by frictional engagement with knot 8. In the preferred embodiment, posterior portion 14, best depicted in FIGS. 3 and 7, comprises bifurcated legs 14*a*, 14*b*, which extend diagonally downwardly and rearwardly of layer 9. Legs 14*a*, 14*b* may further comprise loops 14*c*, 14*d* at the ends thereof. Legs 14*a*, 14*b*, together with loops 14*c*, 14*d*, provide sufficient surface area and frictional force to retain support 11 to knot 8 by friction alone, since, as noted above, support 11 is relatively inelastic.

Figure 8:
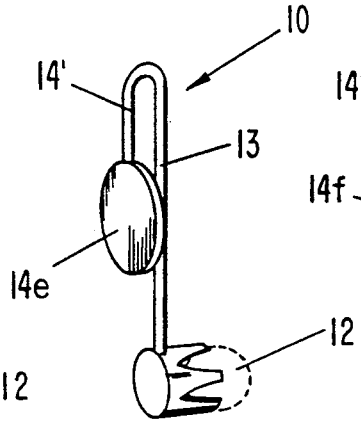
FIG. 8 is a perspective view of an alternate embodiment of the invention.

FIG. 8 shows an alternative embodiment of neckwear knot enhancer 10. This embodiment is similar in all respects to the preferred embodiment with corresponding components being identically numbered, with the exception of posterior portion 14. Posterior portion 14 comprises a single leg 14', with attached flat disk 14*e*. Increased surface area is thus provided thereby increasing the frictional force exerted on knot 8. Increased retention of neckwear knot enhancer 10 thereby results.

Figure 9:
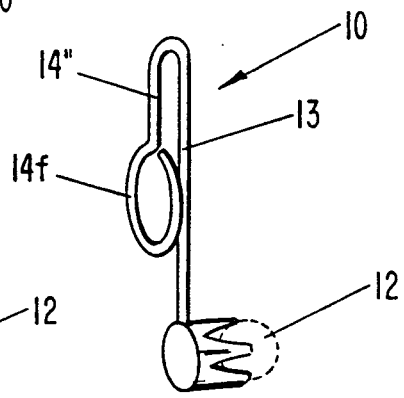
FIG. 9 is a perspective view of another alternate embodiment of the invention.

FIG. 9 depicts another alternative embodiment of the invention. Again, the embodiment of FIG. 9 is similar in all respects to the preferred embodiment and similar components are similarly identified, with the exception of posterior portion 14. Posterior portion 14 comprises a single leg 14'' having attached loop 14*f*. Increased frictional and retentional forces are likewise provided by this configuration.

Figure 10:
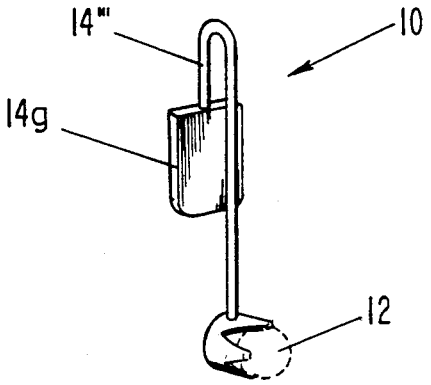
FIG. 10 is a perspective view of yet another alternate embodiment of the invention.
Figure 11:
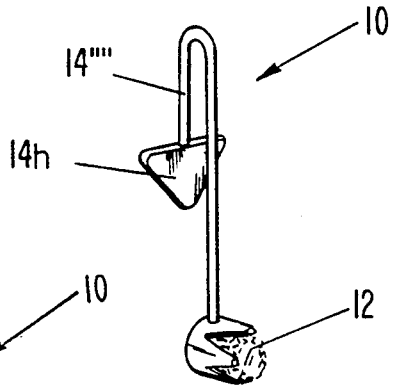
FIG. 11 is a perspective view of still another alternate embodiment of the invention.

FIGS. 10 and 11 present other alternative embodiments of the invention. Both FIGS. 10 and 11 have posterior portions 14, comprising single legs 14''', 14'''', respectively, with plates 14*g*, 14*h* attached. Square plate 14*g* and triangular plate 14*h* provide increased surface area, in turn increasing the frictional force retaining and securing support 11 to knot 9.

Because support 11 is retained solely by frictional force and exerts no spring pressure whatsoever, support 11 may be comprised of various ductile, malleable metals and their alloys, for example, gold, silver, copper, palladium, aluminum, beryllium, indium, iron, nickel, platinum, and the like. Baser metals may be plated, coated, inlaid, or otherwise overlaid by more noble metals. For similar reasons, support 11 may also be comprised of various non-metallic substances, for example, plastic, rubber, ivory, horn, amber, and the like. Selection of composition is normally governed by such characteristics as appearance, shape retention, and frictional properties.

In use, any suitable display device 12 is selectively attached to neckwear knot enhancer 10. Neckwear knot enhancer 10 is then mounted to neckware knot 8 by merely inserting posterior portion 14 behind loop 9, thereby providing an attractive, pleasing, and unique article of jewelry.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A support for a neckwear knot display device comprising:

a downwardly extending anterior portion comprising means for attaching a display device;

a downwardly extending posterior portion in parallel position to said anterior portion and frictionally engaging a neckwear knot; and a connecting portion rigidly and inelastically disposed between said anterior portion and said posterior portion.

2. The invention of claim 1 wherein said anterior portion and said posterior portions are connected by a curved connecting portion.

3. The invention of claim 2 wherein said curved connecting portion extends over the outermost layer of said neckwear knot.

4. The invention of claim 1 wherein said display device attachment means comprises post and spring clamp means.

5. The invention of claim 1 wherein said display device attachment means comprises link and chain means.

6. The invention of claim 1 wherein said display device attachment means comprises threaded connection means.

7. The invention of claim 1 wherein said display device attachment means comprises means selected from the group consisting of welding, brazing, soldering, and bolting.

8. The invention of claim 1 wherein said display device comprises gem means.

9. The invention of claim 1 wherein said display device comprises fraternal emblem means.

10. The invention of claim 1 wherein said display device comprises signet means.

11. The invention of claim 1 wherein said support comprises a metallic substance.

12. The invention of claim 11 wherein said metallic substance comprises at least one member selected from the group consisting of gold, silver, platinum, aluminum, palladium, beryllium, indium, iron, nickel, and alloys thereof.

13. The invention of claim 1 wherein said support comprises a non-metallic substance.

14. The invention of claim 13 wherein said non-metallic substance comprises at least one member selected from the group consisting of plastic, rubber, ivory, horn, and amber.

15. A support for a neckwear knot display device comprising:

an anterior portion comprising means for attaching a display device, wherein said attachment means comprises a member selected from the group consisting of post-and-spring clamp means, link-and-chain means and threaded connection means;

a posterior portion frictionally and inelastically engaging a neckwear knot, wherein said anterior portion and said posterior portion extend downwardly in parallel relationship throughout their entire lengths; and wherein said anterior portion and said posterior portion are rigidly connected and define an anterior slot having a constant depth from front to back of said support.

16. The invention of claim 15, wherein said display device comprises a member selected from the group consisting of gem means, fraternal emblem means, and signet means.

17. A support for a neckwear knot display device comprising:

an anterior portion comprising means for attaching a display device, wherein said display device comprises a member selected from the group consisting of gem means, fraternal emblem means, and signet means;

a posterior portion frictionally and inelastically engaging a neckwear knot, wherein said anterior portion and said posterior portion extend downwardly in parallel relationship throughout their entire lengths; and wherein said anterior portion and said posterior portion are rigidly connected and define an anterior slot having a constant depth from front to back of said support.

* * * * *